US010518185B1

(12) United States Patent
Welby

(10) Patent No.: US 10,518,185 B1
(45) Date of Patent: Dec. 31, 2019

(54) RECONFIGURABLE TOY VEHICLE TRACK SET

(71) Applicant: Mattel, Inc., El Segundo, CA (US)

(72) Inventor: David Welby, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 16/005,735

(22) Filed: Jun. 12, 2018

(51) Int. Cl.
*A63H 18/00* (2006.01)
*A63H 18/02* (2006.01)
*A63H 33/00* (2006.01)

(52) U.S. Cl.
CPC ..... *A63H 18/00* (2013.01); *A63H 18/028* (2013.01); *A63H 33/00* (2013.01)

(58) Field of Classification Search
CPC ..... A63H 18/00; A63H 18/02; A63H 18/026; A63H 18/028; A63H 18/023; A63H 33/101
USPC ..... 446/429, 431, 444, 75
See application file for complete search history.

(56) References Cited

U.S. PATENT DOCUMENTS 1,599,982 A * 9/1926 Bauer ..... A63H 18/026 104/55
1,914,116 A * 6/1933 Ford ..... A63H 19/00 238/10 R
2,853,301 A 9/1958 Glass
3,502,332 A 3/1970 Wolf
3,542,366 A 11/1970 Schocker
3,604,148 A 9/1971 Neuhierl
3,633,308 A 1/1972 Yang
3,658,333 A 4/1972 Carcel
3,735,923 A 5/1973 Brigham
4,077,628 A 3/1978 Herbert
4,108,437 A 8/1978 DeAnda
4,285,157 A * 8/1981 Lambert ..... A63H 18/028 104/55
4,295,649 A 10/1981 Cooper
4,349,983 A * 9/1982 Kilroy ..... A63H 18/02 220/23.4
4,403,440 A 9/1983 Wulff
4,755,159 A * 7/1988 Templeton ..... A63H 3/52 446/110
4,767,053 A 8/1988 Cook
4,937,207 A * 6/1990 Simmell ..... A63H 18/00 104/305
5,102,133 A 4/1992 Chilton
5,299,969 A 4/1994 Zaruba
5,452,893 A 9/1995 Faulk
5,651,736 A 7/1997 Myers
(Continued)

FOREIGN PATENT DOCUMENTS

EP 2517766 A2 10/2012

*Primary Examiner* — Alexander R Niconovich
(74) *Attorney, Agent, or Firm* — Edell, Shapiro & Finnan, LLC

(57) ABSTRACT

A toy vehicle track set is provided. The toy vehicle track set comprises a plurality of track segments. Each track segment of the plurality of track segments has a coupling portion and a plurality of lanes for toy vehicles to race along. The plurality of track segments may be collectively positioned in a racing configuration or a transport configuration. The track segments are coupled together to form a multi-lane raceway in the racing configuration. One or more track segments of the plurality of track segments are positioned to form a rectilinear transport structure in the transport configuration.

20 Claims, 11 Drawing Sheets

(56) References Cited

U.S. PATENT DOCUMENTS 5,813,351 A * 9/1998 Chen ..... A63H 18/02 104/60
5,931,099 A * 8/1999 Bruner ..... A63H 19/00 104/53
6,099,380 A * 8/2000 Rasmussen ..... A63H 33/00 446/476
6,176,760 B1 1/2001 Ngai
6,358,112 B1 3/2002 Lambert
7,628,674 B2 * 12/2009 Nuttall ..... A63H 18/026 446/444
7,651,398 B2 1/2010 Ostendorff
7,690,964 B2 4/2010 Nuttall
7,753,753 B2 * 7/2010 Payne ..... A63H 33/42 446/478
7,892,068 B2 * 2/2011 Nuttall ..... A63H 18/023 446/429
8,016,639 B2 9/2011 Jobe
8,298,038 B2 * 10/2012 O'Connor ..... A63H 18/04 446/429
8,328,596 B2 * 12/2012 Payne ..... A63H 33/42 273/236
8,449,344 B2 5/2013 Nuttall
8,608,527 B2 12/2013 O'Connor
8,668,081 B2 * 3/2014 Hippely ..... A63H 33/003 206/216
8,758,078 B2 * 6/2014 Damarin ..... A63H 18/021 238/10 A
8,790,152 B2 7/2014 Schegel
8,944,882 B2 2/2015 O'Connor
9,050,994 B2 * 6/2015 Nuttall ..... A63H 18/04
9,314,704 B2 * 4/2016 Ostendorff ..... A63H 18/025
9,421,473 B2 8/2016 Ostendorff
9,573,071 B2 * 2/2017 Yu ..... A63H 18/028
9,586,155 B2 3/2017 Hong
2005/0191938 A1 9/2005 Sheltman
2005/0287918 A1 12/2005 Sheltman
2006/0286896 A1 12/2006 Bedford
2006/0286897 A1 12/2006 Bedford
2007/0293122 A1 * 12/2007 O'Connor ..... A63H 18/028 446/429
2008/0014832 A1 * 1/2008 Ostendorff ..... A63H 18/00 446/444
2008/0268743 A1 * 10/2008 O'Connor ..... A63H 18/02 446/429
2010/0056015 A1 3/2010 Nuttall
2010/0081356 A1 * 4/2010 Lutchen ..... A63H 18/021 446/444
2011/0021111 A1 1/2011 Nuttall
2011/0053456 A1 3/2011 Ostendorff
2011/0269370 A1 11/2011 O'Connor
2012/0034984 A1 * 2/2012 Jobe ..... A63K 1/00 472/85
2012/0164914 A1 6/2012 O'Connor
2012/0208431 A1 * 8/2012 Screnci ..... A63H 17/26 446/476
2013/0231028 A1 * 9/2013 Ostendorff ..... A63H 18/026 446/444
2013/0288568 A1 10/2013 Schmid
2014/0329436 A1 * 11/2014 Lennon ..... A63H 17/008 446/429

* cited by examiner

RECONFIGURABLE TOY VEHICLE TRACK SET

FIELD OF THE INVENTION

The present invention relates generally to a raceway or track set for toy vehicles, and in particular track a reconfigurable track set for toy vehicles.

BACKGROUND OF THE INVENTION

Children commonly enjoy toy vehicles by racing the toy vehicles on tracks or raceways. Such raceways may be a simple straight track or include various shapes and geometries such as curves, loops, and ramps. To provide greater play value and enjoyment, it is desirable for the raceway to be reconfigurable into different track layouts. Thus, track sets for toy vehicles have been created which include multiple individual track segments that may be assembled into different track layouts.

However, track sets containing multiple track segments may be difficult to transport and store. Thus, there is a need for a track set that can transform to self-contain all of its individual track segments for easy transportation and storage.

SUMMARY OF THE INVENTION

The present invention provides a toy vehicle track set that is reconfigurable between a racing configuration and a transport configuration. In the racing configuration, individual track segments are coupled together to form a continuous raceway for toy vehicles. Various raceway layouts can be created by assembling the track segments in different sequences and arrangements. In the transport configuration, at least some of the track segments are positioned to form a rectilinear structure or crate that can be used to store and transport all of the individual track segments (e.g., a subset of track segments can form a crate and any remaining track segments included in the track set can be stored within the crate). Since the track set can transform between a racing configuration and transport configuration, the track set allows a large reconfigurable raceway for toy vehicles to be easily transported and conveniently stored in a small space.

According to one aspect of the present invention, the toy vehicle track set comprises a plurality of track segments. Each track segment of the plurality of track segments has a coupling portion and a plurality of lanes for toy vehicles to race along. The plurality of track segments may be collectively positioned in a racing configuration or a transport configuration. In the racing configuration, the plurality of track segments are coupled together to form a multi-lane raceway. In the transport configuration, one or more track segments of the plurality of track segments are positioned to form a rectilinear transport structure.

In at least some of these embodiments, the plurality of track segments define or are contained within the rectilinear transport structure. Additionally or alternatively, at least one track segment of the plurality of track segments may be separable from other track segments of the plurality of track segments to enable reconfiguration of the multi-lane raceway.

Moreover, in some embodiments, one of the track segments of the plurality of track segments may be a main track segment and one or more other track segments of the plurality of track segments are hingedly coupled to the main track segment. In one embodiment, these track segments are inseparably hingedly coupled to the main track segment. In the transport configuration, the track segments hingedly coupled to the main track segment are pivoted to form one or more wall segments of the rectilinear transport structure. In one or more embodiments, at least one of the one or more wall segments retains another one of the track segments of the plurality of track segments while the track set is in the transport configuration. In some embodiments, two of the one or more wall segments are configured to be folded along opposite edges of the main track segment and provide elevation to the main track segment in the racing configuration. In other embodiments, one of the one or more wall segments is configured to be folded to form a top lid of the rectilinear transport structure. In yet other embodiments, at least one track segment of the plurality of track segments includes a latch configured to releasably engage with another track segment of the plurality of track segments while the track set is in the transport configuration.

In one or more embodiments, one or more track segments of the plurality of track segments include a plurality of upstanding parallel ribs that define the plurality of lanes. In some embodiments, a first track segment of the plurality of track segments includes a directional indicator for orienting the first track segment when being coupled to another track segment of the plurality of track segments. Still further, in some embodiments, one end of the plurality of track segments includes a hinged male connector and an opposite end of the plurality of track segments includes a female connector. Additionally or alternatively, each track segment of the plurality of track segments may include a first end with a hinged male connector and an opposite end with a female connector to allow any of the track segments in the plurality of track segments to be coupled end-to-end in the racing configuration.

In one or more embodiments, at least one of the track segment of the plurality of track segments is selected from the group consisting of a straight track, a loop, a racing order indicator, and a starting gate assembly. The track set may also include a toy vehicle launcher that is coupleable to one of the track segments of the plurality of track segments.

In one or more embodiments, at least one track segment of the plurality of track segments includes a pivotable support member configured to support the at least one track segment in an angular position. Additionally or alternatively, at least one track segment of the plurality of track segments may be a foldable track segment and include two pivotable support members configured to support the folded track segment in a zig-zag configuration. In at least some instances, the foldable track segment further includes a hingedly connected multi-lane racing surface.

According to another embodiment of the present invention, the toy vehicle track set comprises a main track segment, a plurality of wall segments, and a plurality of connectable track segments. The wall segments are hingedly coupled to the main track segment so that the plurality of wall segments can pivot to orthogonal positions along edges of the main track segment to form a transport structure. Each connectable track segment of the plurality of connectable track segments is coupleable to one of the plurality of wall segments and/or another one of the plurality of connectable track segments to construct a raceway for toy vehicles.

Other objects, features and advantages of the present invention will become apparent to those skilled in the art from the following detailed description. It is to be understood, however, that the detailed description and specific examples, while indicating some embodiments of the invention, are given by way of illustration and not limitation.

Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout.

FIG. 7A illustrates a top view of the track set. FIG. 7B illustrates a side view of the track set where the wall segments are pivoted along the edges of the main track segment to form the sides of a transport structure.

FIG. 8A illustrates a top view of the track set while dissembled from the racing configuration, but prior to pivoting the wall segments with respect to the main segment. FIG. 8B illustrates a perspective view of the track set while the wall segments are pivoted along the edges of the main track segment to form the sides of a transport structure with a top lid opened. FIG. 8C illustrates a close-up perspective view of the track set prior to completing the transformation to the transport configuration. FIG. 8D illustrates a perspective view of the track set in a transport configuration (forming the transport structure).

FIG. 9A illustrates a side perspective view of the loop assembly. FIG. 9B illustrates a top view of the loop assembly with a portion of the loop removed from a loop base; FIG. 10A illustrates a front view of the racing order indicator and FIG. 10B illustrates a rear view of the racing order indicator.

DETAILED DESCRIPTION OF THE INVENTION

A toy vehicle track set according to the present invention converts between a racing configuration and a transport configuration. Generally, the track set comprises a plurality of track segments that can be reconfigured to create different track layouts as well as a self-contained transport structure for storing and transporting the components of the track set (insofar as "self-contained" is used herein to denote that the transport structure can transport any and all components of the track set, with some components forming the transport structure and other components being stored therein). Converting the track set between a racing configuration and a transport configuration allows a large raceway for toy vehicles to be easily stored and transported when not in use.

In one aspect of the invention, multiple track segments are coupled together in a racing configuration to form a raceway for toy vehicles. The track segments may be coupled in different orders and arrangements, which gives a child the freedom to creatively construct different raceway layouts. Typically, the track segments are coupled end-to-end to form a long, continuous raceway. In some instances however, a gap may also be introduced between two track segments which require a toy vehicle to jump across the gap when traveling along the raceway. Unless otherwise specified, the toy vehicle track set may, but is not required to, contain at least one of the track segments, structures, components, functionality, and/or variations described, illustrated, and/or incorporated herein.

Figure 1:
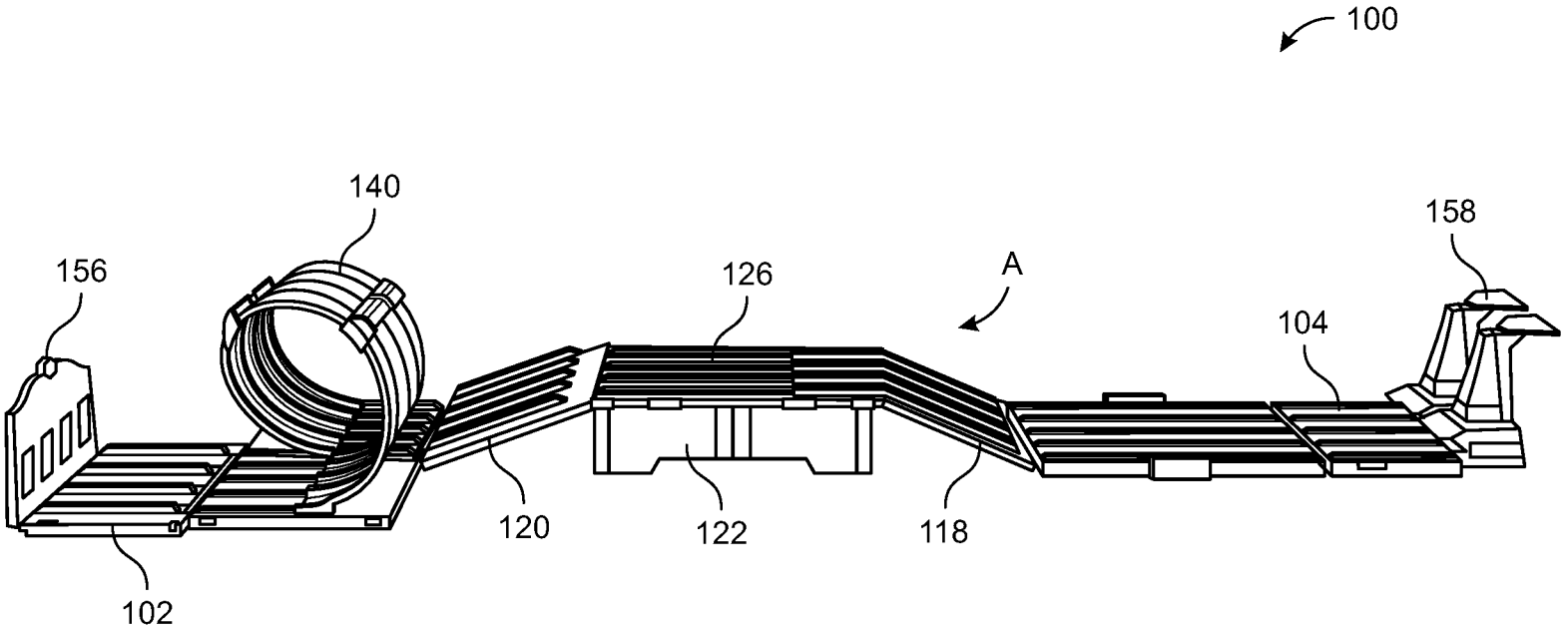
FIG. 1 illustrates a side perspective view of a track set in a racing configuration with a first raceway layout, in accordance with an embodiment of the invention.

FIG. 1 provides an illustrative embodiment of a toy vehicle track set 100 in a racing configuration A. While in the racing configuration A, one or more track segments are coupled together such that the track set 100 forms a raceway for toy vehicles. The track segments may be any suitable rigid or semi-rigid structure configured to facilitate the racing of toy vehicles in one or more lanes. Specific examples of different types of track segments that may be included as part of the track set are described in further detail herein.

Figure 2:
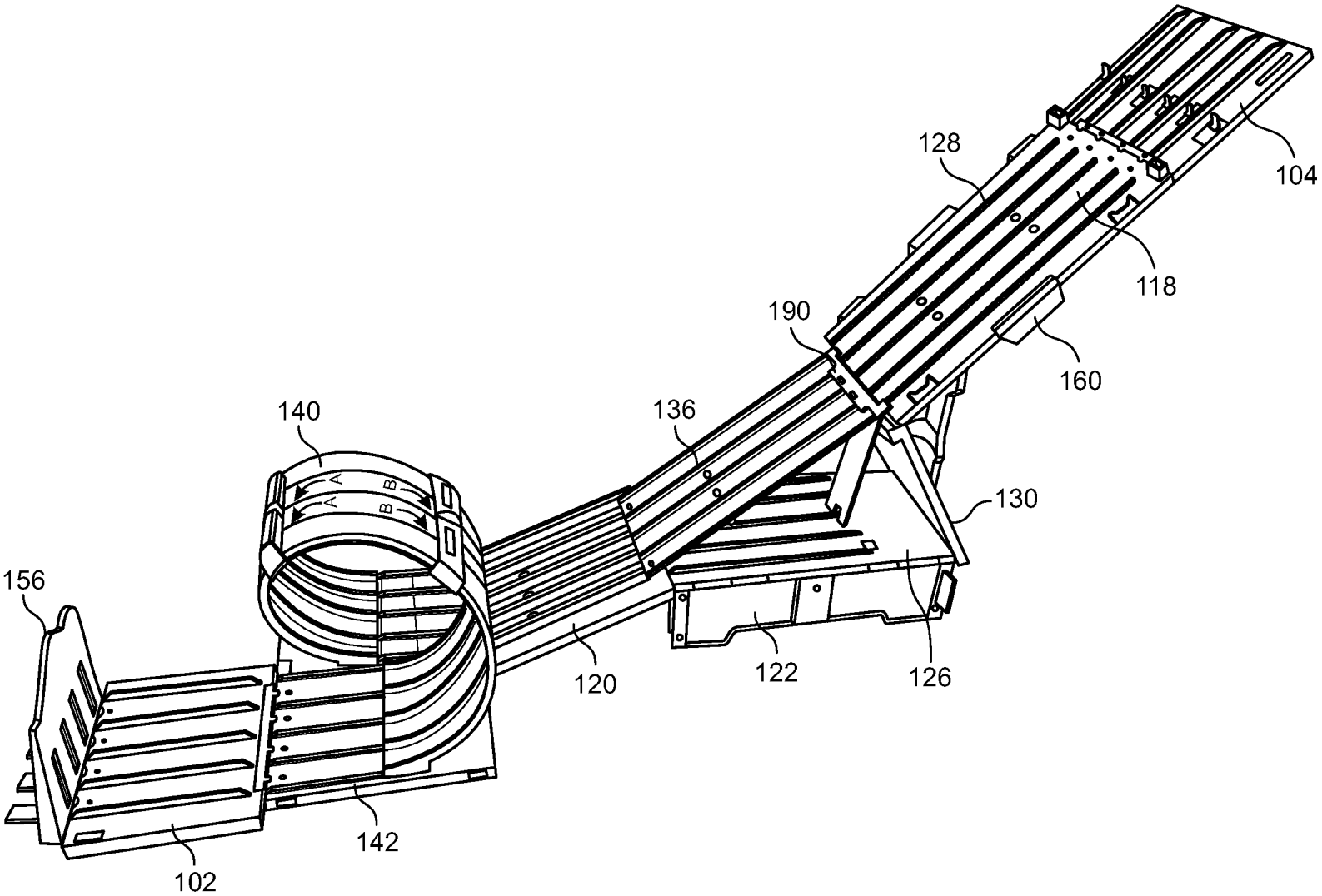
FIG. 2 illustrates a side perspective view of the track set of FIG. 1 in the racing configuration, but with a second raceway layout, in accordance with an embodiment of the invention.

As shown in FIG. 2, the track segments may be reconfigured into a different track layouts. Additional track segments may be further included to build a longer and/or more complex raceway. Furthermore, certain track segments may be removed or duplicate types of track segments may be used, for example to create a long, straight raceway.

Figure 9A:
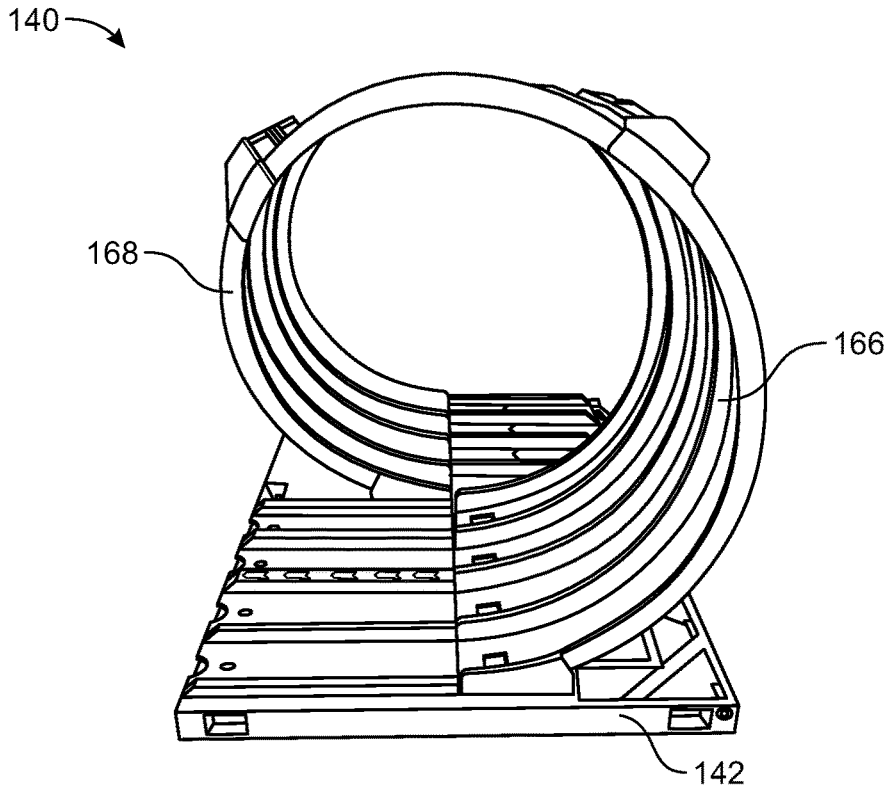
FIGS. 9A and 9B illustrate various views of a loop assembly included in the track set of FIG. 1, in accordance with an embodiment of the invention.
Figure 9B:
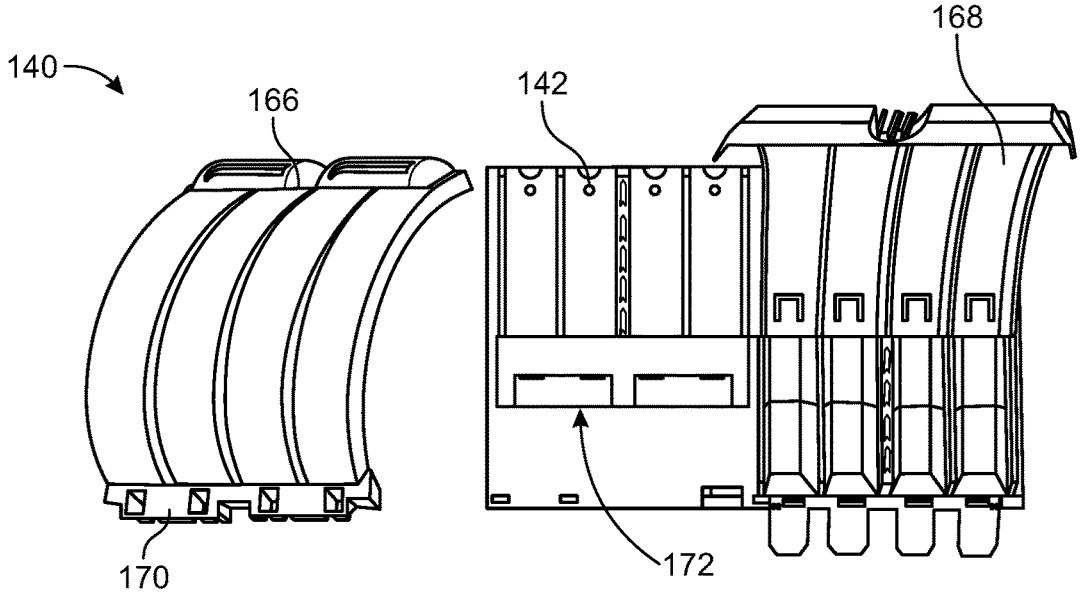
Figure 10A:
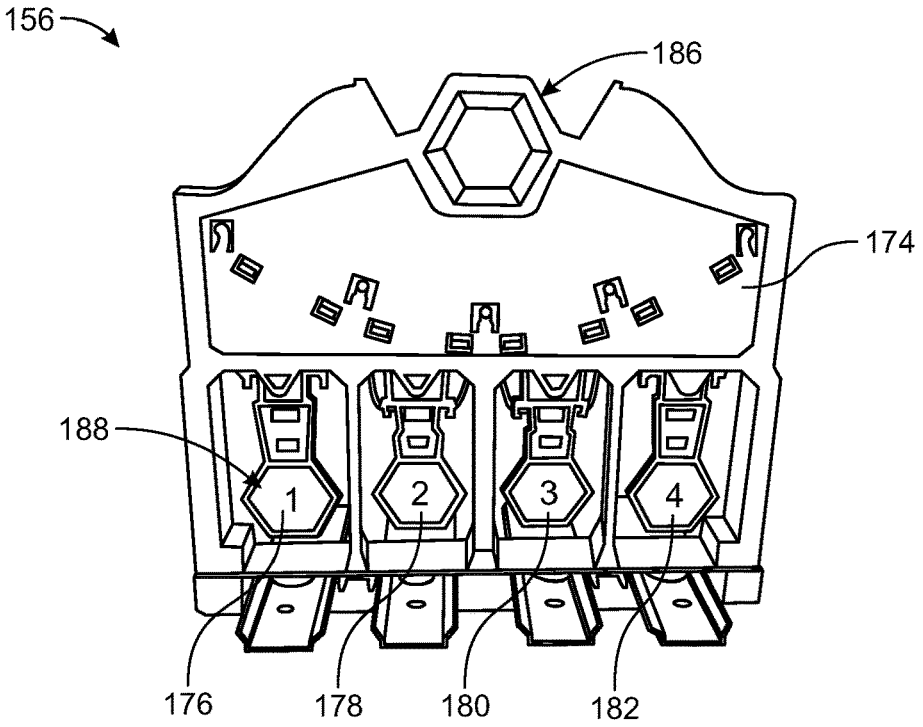
FIGS. 10A-B illustrate various views of a racing order indicator included in the track set of FIG. 1, in accordance with an embodiment of the invention.
Figure 10B:
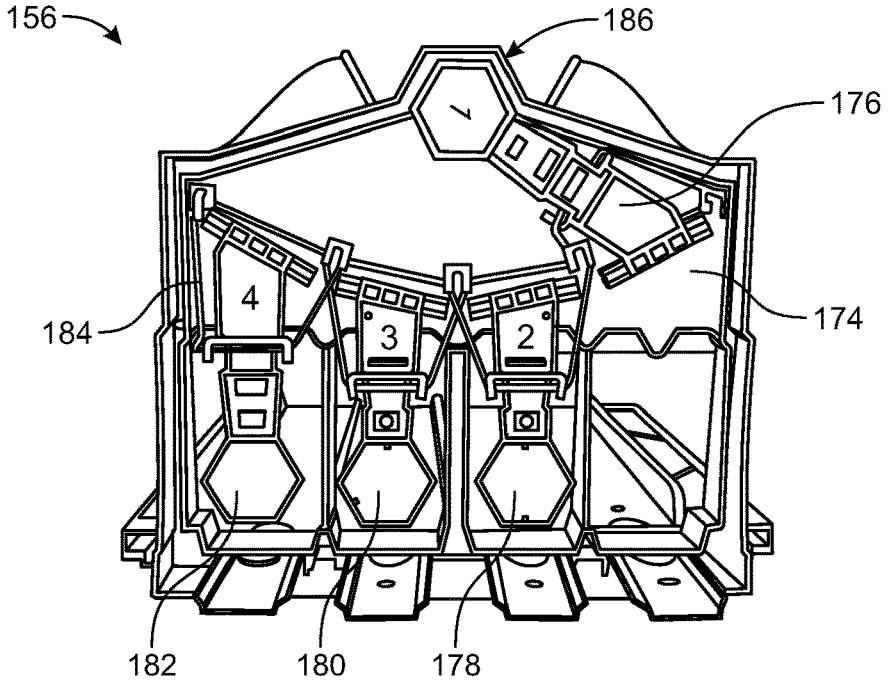

Exemplary track segments, as shown in the raceways of FIGS. 1 and 2, include a straight track 102 (see FIG. 3), a starting gate assembly 104 (see FIG. 4), a loop assembly 140 (see FIGS. 9A-B), and a racing order indicator 156 (see FIGS. 10A-B). In addition to these track segments, the illustrative track set 100 may also include toy vehicle launchers 158 that are coupled to one end of the raceway. The vehicle launchers 158 allow a child to propel or launch a toy vehicle across the raceway more easily and/or at a greater velocity. Generally, a child loads a toy vehicle in the launcher 158 and then activates the launcher to propel the vehicle. In one example, the child provides a force (such a smashing a lever) that the launcher translates to a propulsion force that launches the vehicle. In another example, the child pushes a button on the launcher that allows a spring or biasing member to propel the vehicle.

Typically, each of the track segments includes a coupling portion or track connector at a first end and/or second end. The track connector may be any structure suitable for facilitating selective end-to-end connection or coupling of a track segment to another track segment or a component of the track set (e.g., vehicle launcher). For instance, the track connector may be configured as tongue-and-groove friction-fit connectors or snap-together nesting tabs.

Figure 3:
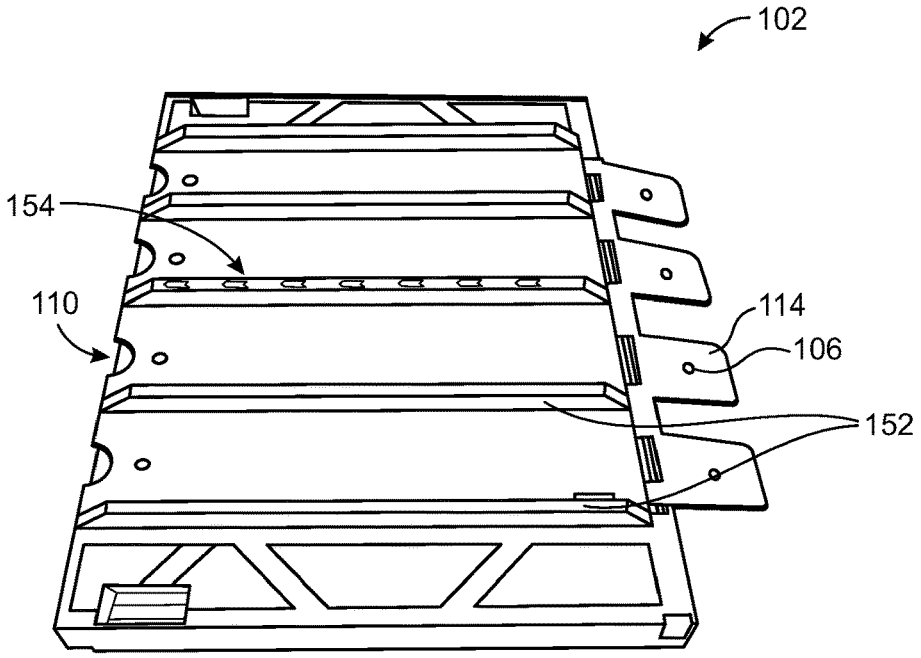
FIG. 3 illustrates a side perspective view of a straight track included in the track set of FIG. 1, in accordance with an embodiment of the invention.
Figure 4:
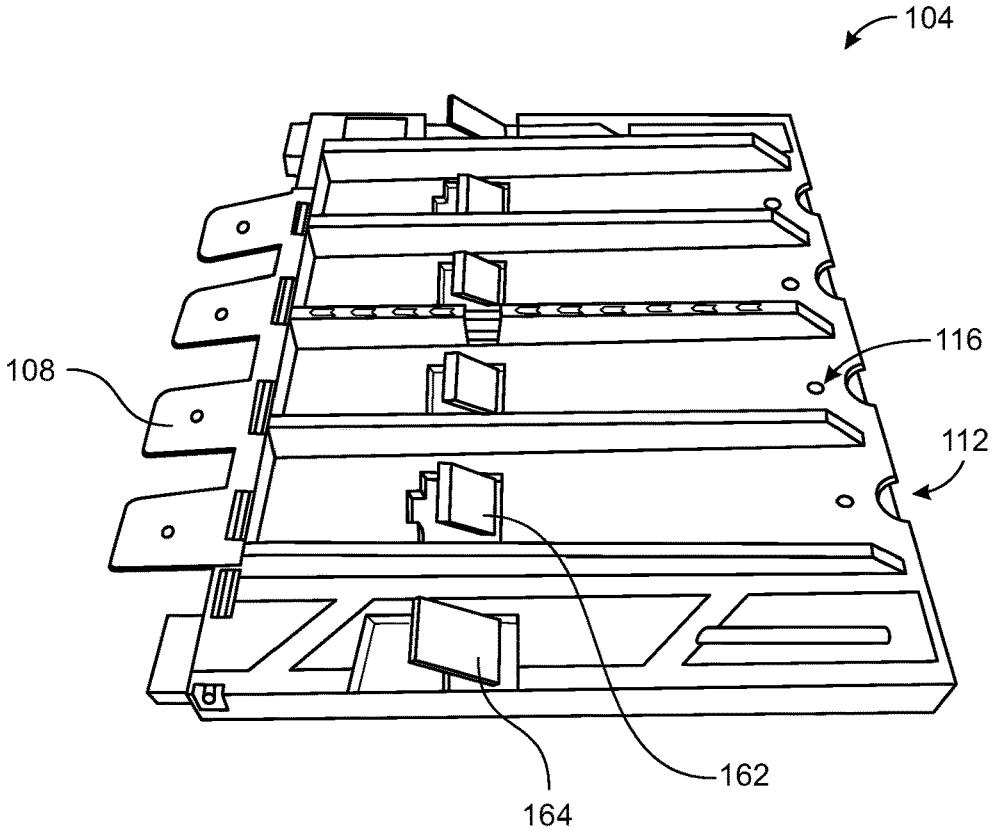
FIG. 4 illustrates a side perspective view of a starting gate assembly included in the track set of FIG. 1, in accordance with an embodiment of the invention.

FIGS. 3 and 4 show two types of track segments, a straight track 102 and a starting gate assembly 104. The straight track 102 has a male track connector 106 at one end and a female track connector 110 at the other end. The starting gate assembly 104 has a similar male track connector 108 at one end and a female track connector 112 at the other end. These coupling portions allow the track segments to couple with each other and/or with other track segments. For example, the starting gate assembly 104 may be coupled to the straight track 102 by engaging the male track connector 108 of the starting gate assembly 104 with the female connector 110 of the straight track 102.

In some instances, the male track connectors include protrusions that are positioned to engage with a hole or depression on the female connector to provide a more secure connection. For example in FIGS. 3 and 4, the male track connector 106 includes a protrusion 114 on the surface of the male track connector 106 that engages with a hole 116 on the female connector 112 when the male track connector 106 is coupled with the female connector 112. Additionally, each track segment may have a plurality of track connectors, for example a male connector and female connector for each lane on the track segment. As shown in FIG. 3, the straight track 102 has four male and female connectors for its four lanes.

The track connectors are preferably hingedly or pivotably coupled to their respective track segment such that adjacent track segments can pivot relative to each other. In the illustrative examples shown in FIGS. 3 and 4, the male track connectors 106, 108 are hinged to allow track segment 102 and starting gate assembly 104 to be foldable and angularly adjustable when coupled together as a continuous raceway (e.g., when coupled to segments 142 and 118, respectively, as shown in FIGS. 1 and 2). The hinges also allow the male connectors 106, 108 to be pivoted away from the end of the track segments (e.g., to move perpendicular to a track segment), which is useful for example, when storing the track segments. Hinged attachment may be accomplished by any suitable pivoting structure. For example in one or more embodiments, the hinge includes one or more hinge knuckles and hinge pins. In other embodiments, a breakaway double hinge is used. A double hinge includes a joint having two pivoting connectors, one of which may be configured to break apart non-destructively if sufficient force is applied, such as when a child inadvertently steps on the joint. In yet further embodiments, one or more of the hinges are configured to prevent rotation in a particular rotational direction and/or rotation beyond a predetermined angle, such as 180 degrees.

Hingedly coupling the track segments together allows the track segments to be pivoted and adjusted to different angular positions relative to each other. This creates additional variability to the layout of the raceway. For example in FIG. 1, track segments 118 and 120 are respectively positioned as upward and downward slopes in the raceway. Furthermore, track segments 122 and 124 (not shown, but included opposite track segment 122) are pivoted to be perpendicular underneath a main track segment 126. This provides support to the main track segment 126 while it is elevated above a support surface or floor.

By comparison, in the example shown in FIG. 2, track segment 118 is pivoted to be downwardly angled. This configuration eliminates the need for a vehicle launcher. Toy vehicles may be placed on a starting gate assembly 104 that is coupled to the track segment 118. Upon release by the starting gate assembly 104, the toy vehicles travel across the raceway due to the gravitational force acting on them.

In one or more embodiments, the track segments are configured as multi-lane track segments such that a multi-lane raceway is formed when the track segments are coupled together in the racing configuration A (see, e.g., FIGS. 1 and 2). Each track segment includes a plurality of parallel racing surfaces or lanes that a toy vehicle can travel along. In the illustrative example shown in FIG. 1, the track segments provide four continuous lanes when coupled together to form a raceway. Embodiments of the track segments include any suitable number of spaced apart lanes, such as two, three, four, or even five or more lanes.

The racing surfaces or lanes are configured to guide the toy vehicles along the raceway. In one or more embodiments, the track segments include a plurality of upstanding parallel ribs that define a plurality of spaced apart lanes for the toy vehicles. FIG. 3 for example, shows a straight track 102 with ribs 152. In other embodiments, rather than a pair of ribs disposed on opposing sides of the traveling surface, the guiding structure is a ridge running down the center of the lane. In such instances, the toy vehicle includes one or more pairs of wheels that straddle the ridge when traveling along the lane.

In one or more embodiments, each track segment further includes directional indicators to indicate how that particular track segment should be oriented when being coupled to another track segment or component. For example in FIG. 3, straight track 102 includes arrows 154 that indicate that a toy vehicle should be traveling from right to left along the track segment (in the orientation shown in FIG. 3). When multiple track segments are coupled together to form a raceway, the arrows on all the track segments should be pointing in the same direction.

FIG. 4 shows a starting gate assembly 104. In this illustrative embodiment, starting gate assembly 104 includes four retention/release members or gate flaps 162 and an activation member or pivoting actuator arm 164 operatively connected through an axle to the gate flaps 162. Actuator arm 164 is configured to move gate flaps 162 between a raised position with the gate flaps 162 substantially orthogonal to the surface of the track segment, and a lowered position with the gate flaps 162 substantially coplanar with the surface of the track segment. In the raised position, the gate flaps 162 retain the toy vehicles on the track segment and prevent them from traveling forward. By moving the actuator arm 164 towards the surface of the track segment, the gate flaps 162 pivot to the lowered position and become substantially coplanar with the surface of the track segment, thereby releasing the toy vehicles. Embodiments of the starting gate assembly also include any suitable structure configured to selectively release one or more toy vehicles for travel along the raceway.

Figure 5:
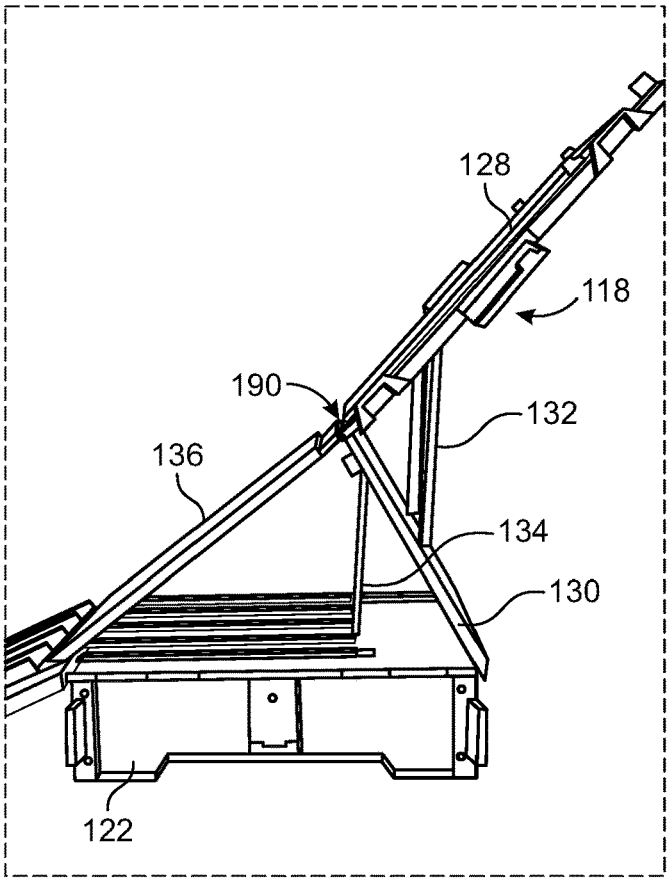
FIG. 5 illustrates a side perspective view of a wall segment included in the track set of FIG. 1, the wall segment being folded into a zig-zag configuration, in accordance with an embodiment of the invention.

Now turning to FIG. 5, but with reference to FIG. 2 as well, track segment 118 further includes a hinge 190 (see FIG. 2) that allows portions of the track segment 118 to be pivoted. A first portion 128 pivots in a rotational direction relative to a second portion 130 that is opposite to the rotational direction that the second portion 130 pivots relative to the main track segment 126. As a result, track segment 118 is folded into a Z-fold, zig-zag, or accordion-like manner Embodiments of the invention include track segments having any number of additional hinges. Depending on the number of hinges, track segments may be folded into other configurations, for example in a nesting or spiral manner. In spiral configuration, adjacent portions pivot in the same rotational direction such that successive portions of the track segment fold in on each other.

As shown more closely in FIG. 5, track segment 118 includes two pivotable support members 132, 134 that prop the folded track segment 118 in the zig-zag configuration.

Figure 6:
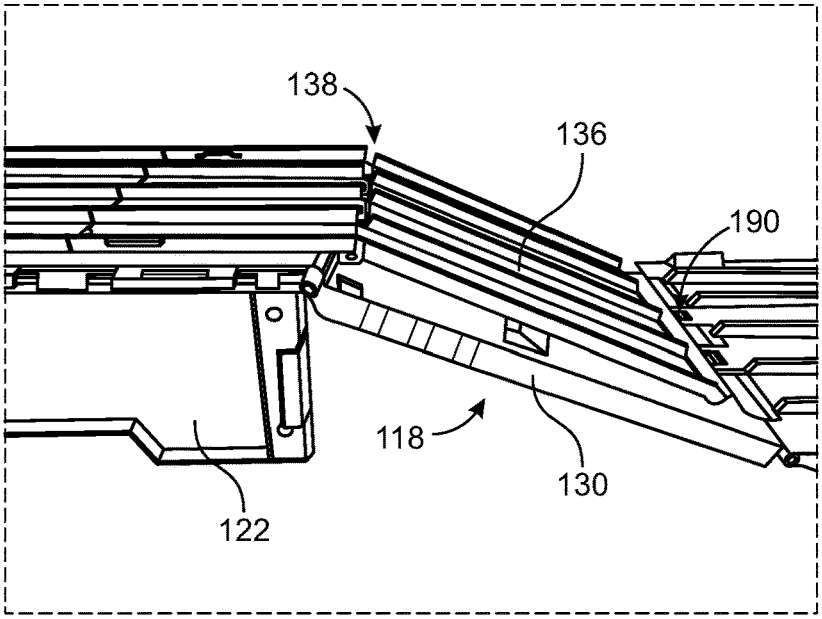
FIG. 6 illustrates a side perspective view of a portion of the wall segment of FIG. 5, in accordance with an embodiment of the invention.

The support members 132, 134 pivot between a supporting position and a storage position. In the supporting position, the support members 132, 134 are in an angled relationship with the first portion 128 and the second portion 130, respectively. In the storage position, the support members 132, 134 are substantially coplanar to the first and second portions 128, 130 (see, e.g., FIG. 6). In one or more embodiments, the pivotable support members 132 and/or 134 can be shifted to adjust the angles of the first portion 128 and the second portion 130 of the track segment 118. Embodiments of the invention include track segments having any number of pivotable support members (for example one or more than two support members) configured to at least partially elevate and/or support one or more portions of the track segment.

Track segment 118 also has a hingedly connected racing surface 136. The racing surface 136 allows the track segment 118 to connect a portion of the raceway to another track segment even though the track segment 118 is in a zig-zag configuration. Furthermore, the racing surface 136 has a hinge 138 that allows a portion of the racing surface 136 to be pivoted (see, e.g., FIG. 6). With the hinge 138, the racing surface 136 is able to be folded to complement the shape of the track segment 118, for instance when the track segment 118 is positioned in an incline configuration. In one or more embodiments, the edge of the racing surface 136 includes a mating component that engages with another track segment to secure the positioning of the racing surface 136.

Figure 7A:
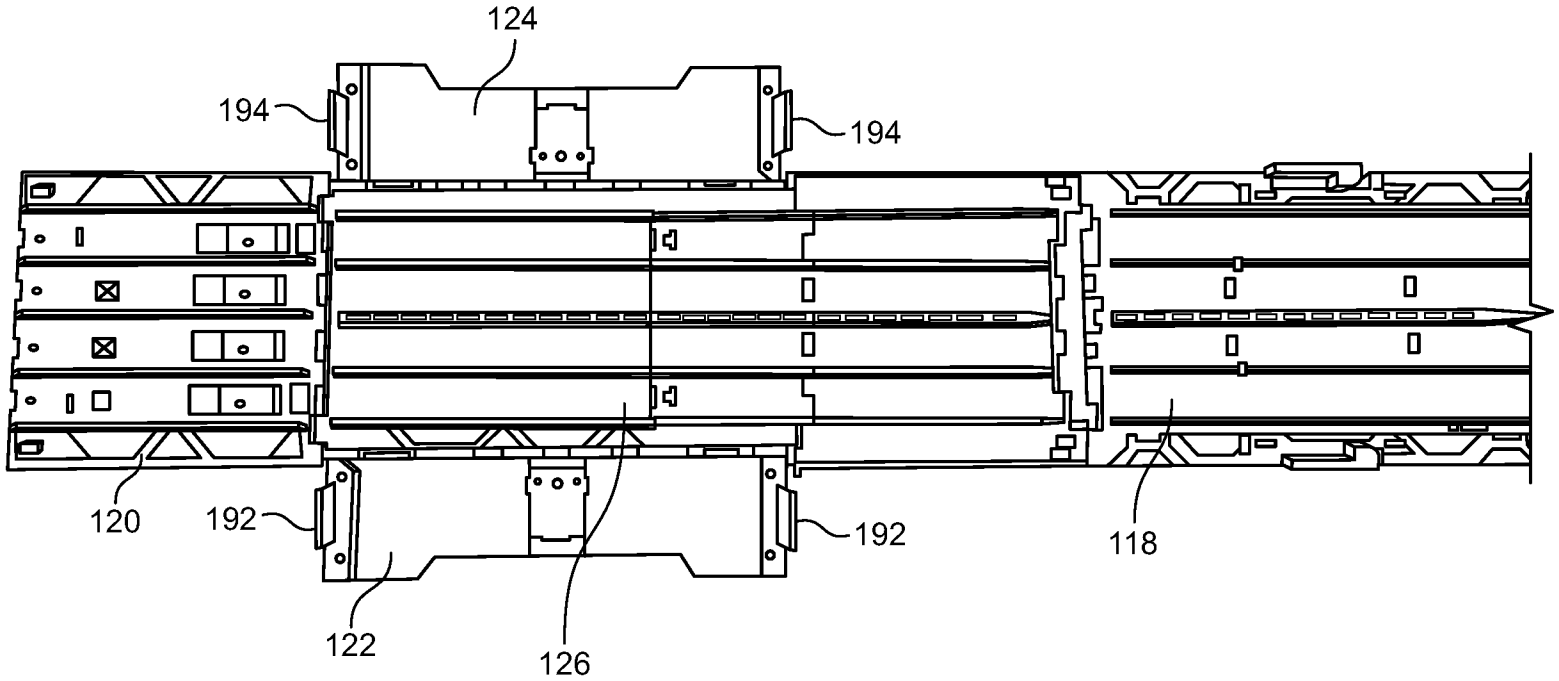
FIGS. 7A and 7B illustrate various views of a main track segment included in the track set of FIG. 1 with wall segments hingedly connected thereto, in accordance with an embodiment of the invention.

In another aspect of the invention, multiple track segments are hingedly coupled together such that they can be pivoted and folded to form a rectilinear box-like structure. In one or more embodiments, the track segments are hingedly coupled to the edges of a main track segment such that they can be pivoted to form wall segments lining the perimeter of the main track segment. In the illustrative example shown in FIG. 7A, the track segments 118, 120, 122, and 124 are hingedly coupled to the sides of a main track segment 126. In this embodiment, the track segments 118, 120, 122 and 124 are inseparably hingedly connected to the main track segment 126 and, thus, cannot be de-coupled from the main track segment 126. In other embodiments, the track segments 118, 120, 122 and 124 are releasably coupled to the main track segment 126, for example with the hinged male connectors described above.

Figure 7B:
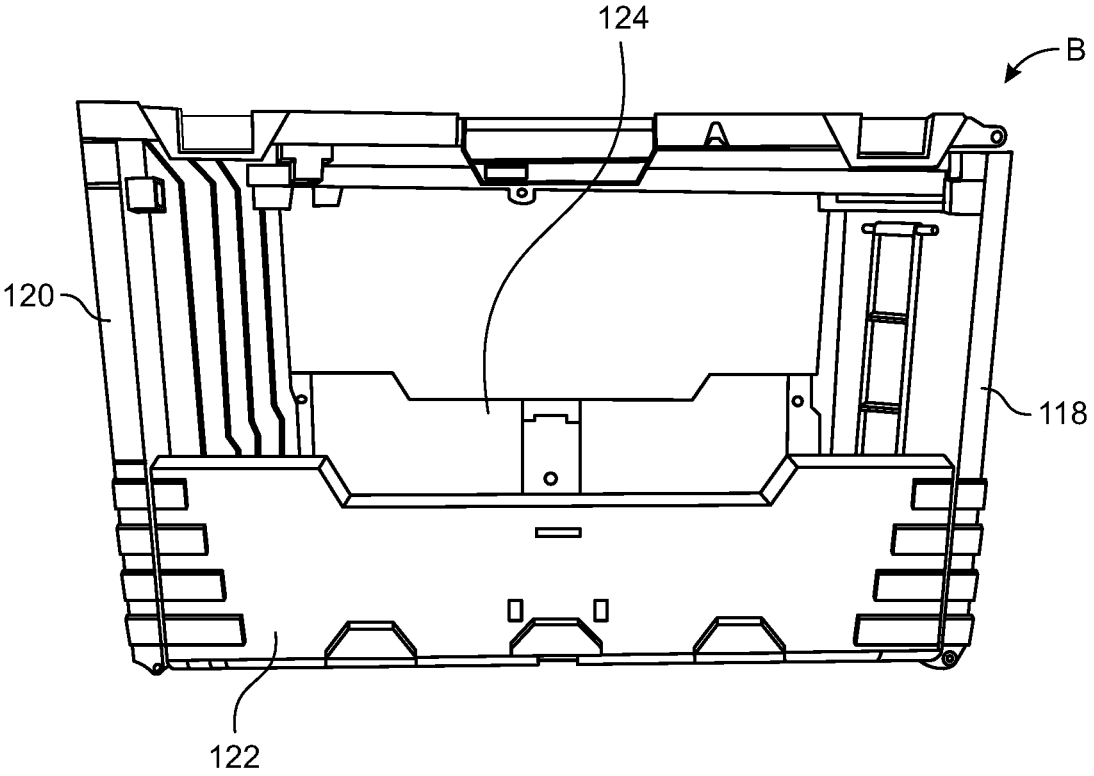
Figure 8A:
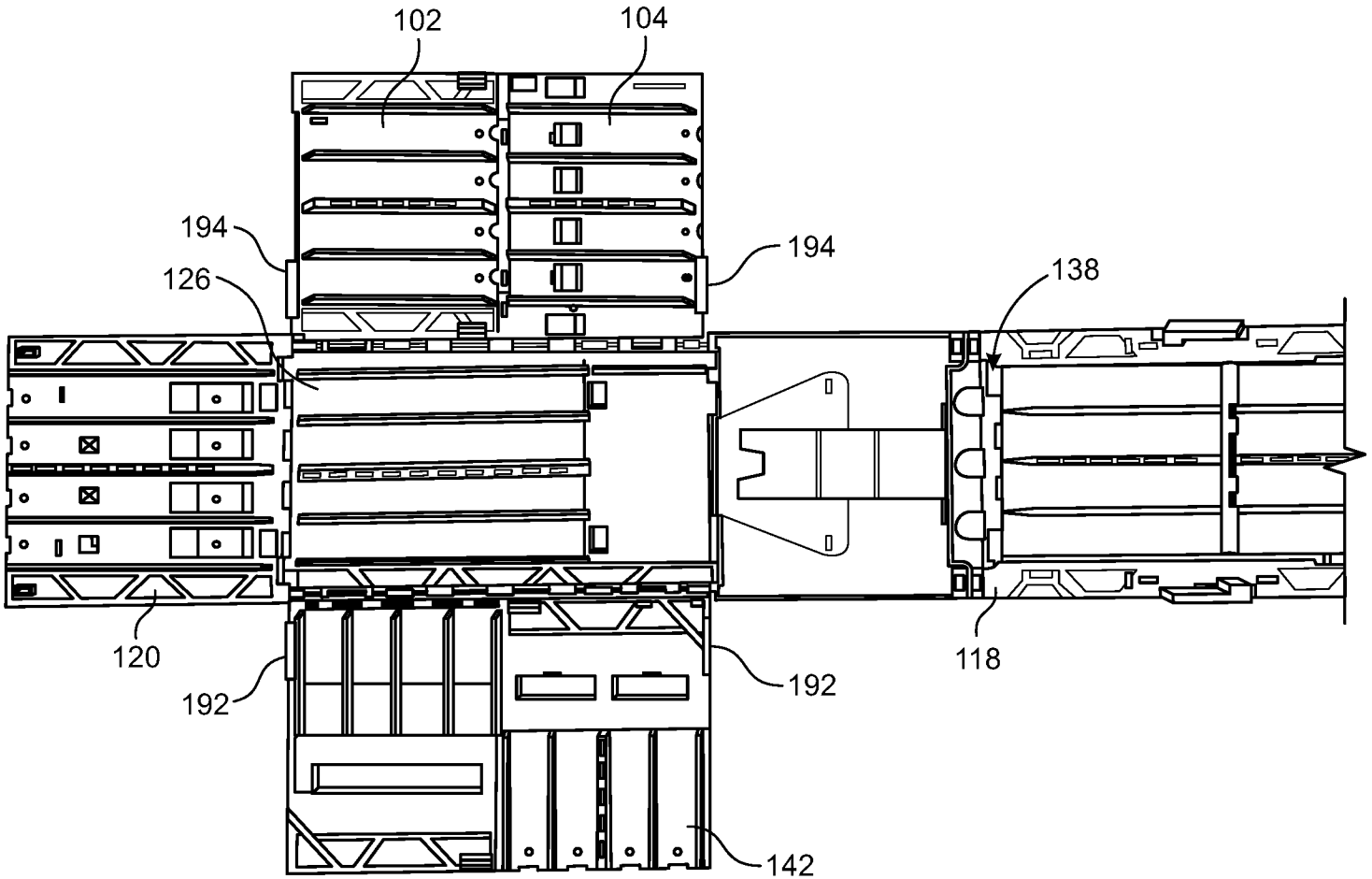
FIGS. 8A-D illustrate various views of the track set of FIG. 1 while transforming into the transport configuration, in accordance with an embodiment of the invention.

As shown in FIG. 7B, the track segments 118, 120, 122 and 124 can be pivoted along the edges of the main track segment 126 to form corresponding wall segments of a transport structure, with the main track segment 126 forming the bottom of the transport structure. This allows the track set 100 to convert between a racing configuration A (as shown in FIGS. 1 and 2) and a transport configuration B (as shown in FIGS. 7B and 8D). The relatively more compact arrangement of the track set 100 in the transport configuration B provides enhanced transportability of the track segments and other components of the track set 100.

In some embodiments, additional track segments may be retained by one or more of the wall segments (e.g., track segments other than segments 118, 120, 122, and 124). In the illustrative example shown in FIG. 8A, straight track 102 and starting gate assembly 104 are both retained by the wall segment 124 and a loop base 142 is retained by the wall segment 122 (see, also FIG. 7A). More specifically, track segment 102 and starting gate 104 are retained by L-shaped arm 192 that extend from the sides of wall segment 124 while the loop base 142 is retained by L-shaped arms 194 that extend from the sides of the wall segment 122. The retained track segments 102, 104, and 142 also function as walls or sides for the transport structure 200 while the track set 100 is in the transport configuration B (see, e.g., FIG. 8B).

Figure 8B:
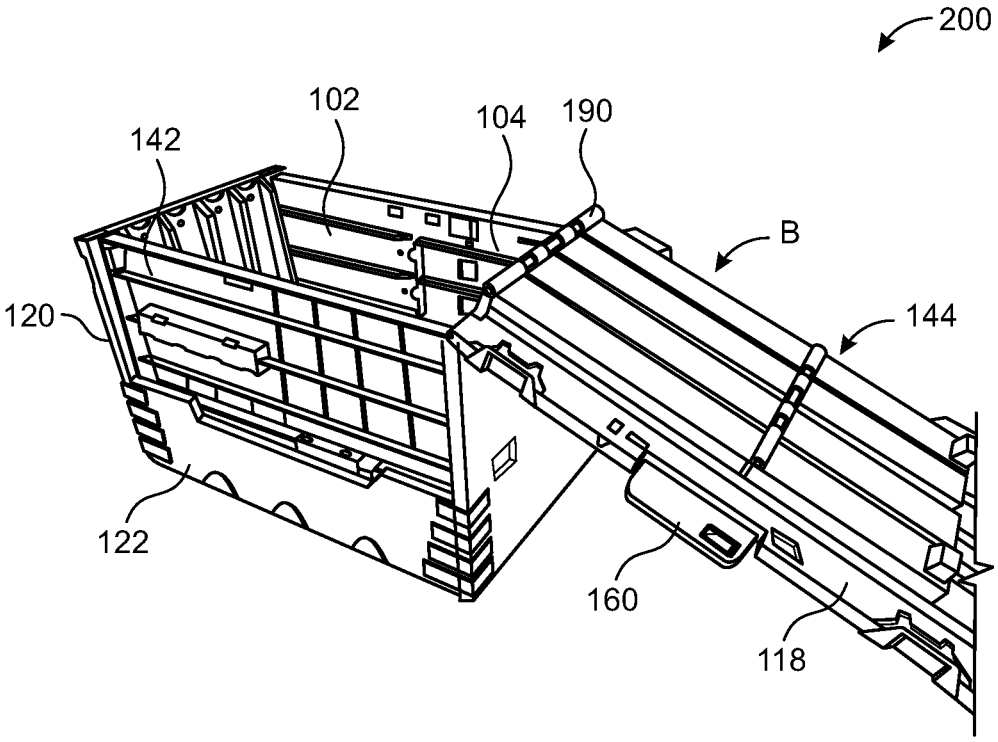

As shown in FIG. 8B, the rectangular transport structure or crate 200 defines a cavity in which track segments and other components and accessories (e.g., vehicle launchers, loop sections, toy vehicles) may be stored. Wall segment 118 is foldable along a hinge 190 to form a top lid 144 for the rectangular transport structure 200. This allows the top lid 144 to pivot open and close to allow access to the interior of the storage compartment. In the depicted embodiment, wall segment 118 also includes a latch 160 configured to releasably mate with a corresponding structure on one of the other track segments while the track set 100 is positioned in the transport configuration B.

Figure 8C:
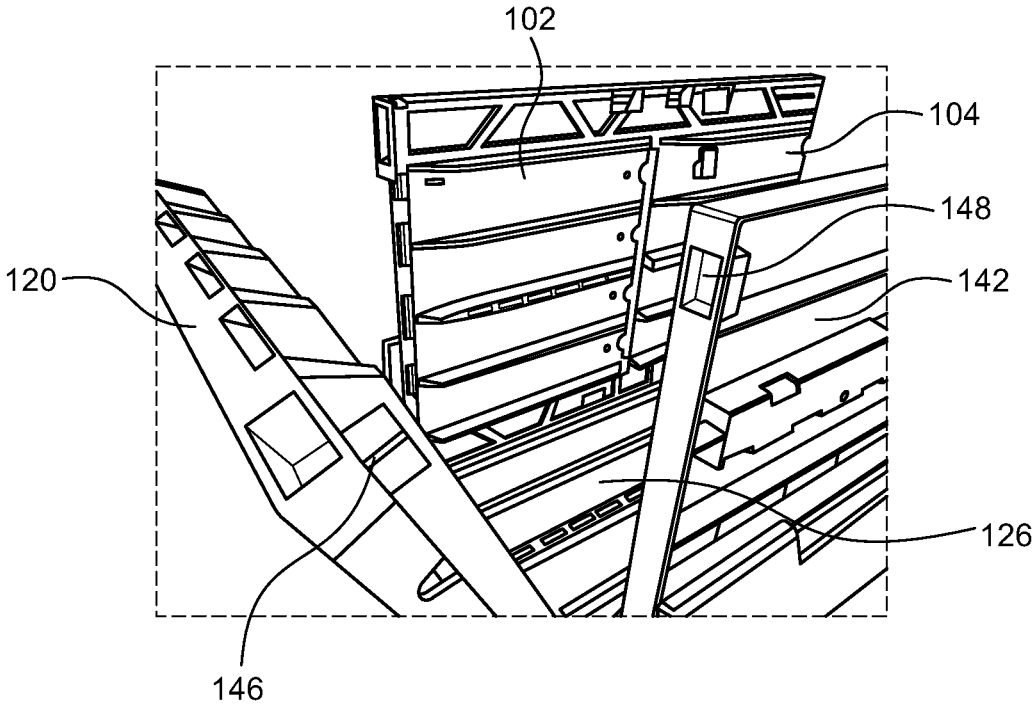
Figure 8D:
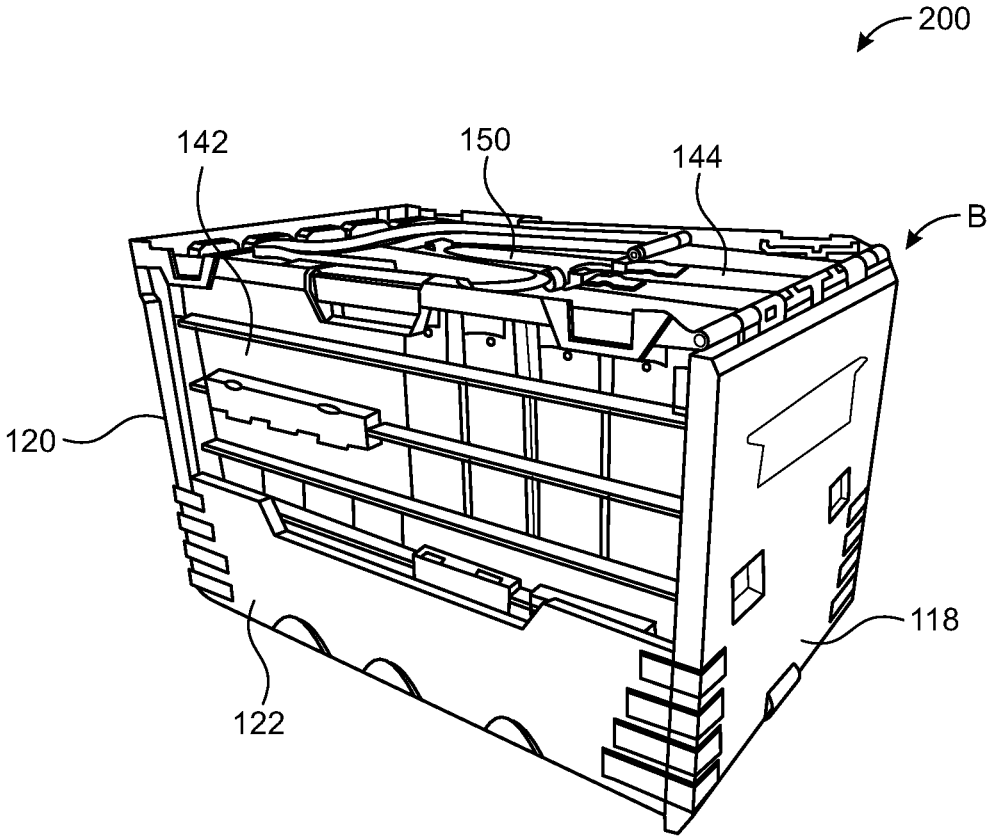

As shown in FIG. 8C, the track segments include engagement members to help retain the structure of the transport case 200 while the track set 100 is in the transport configuration B. For example, wall segment 120 has a protrusion 146 that friction fits into a cavity 148 in the loop base 142. Similar engagement members are located on other edges and corners of the transport case 200. Other methods of coupling the sides of the transport case 200 may also be used, for example with clips, hooks or latches.

FIG. 8D shows the track set 100 in the transport configuration B. All the components of the track set 100 are self-contained in the rectangular transport structure 200 (e.g., the components define or are contained within the transport structure 200). A carrying handle 150 is positioned on the top lid 144 to allow a child to easily lift and carry the transport structure 200. In some embodiments, wheels may be positioned on the bottom of the transport structure 200.

FIGS. 9A and 9B show a loop assembly 140. In this illustrative embodiment, the loop assembly 140 includes multiple loops sections 166, 168 that are assembled onto a loop base 142. This allows the loop assembly 140 to be taken apart when stored within the transport structure 200. As shown in FIG. 9B, mating portions 170 of the loop section 166 are able to engage with recesses 172 in the loop base 142. A continuous loop is formed by engaging the loop sections 166, 168 with the loop base 142 and coupling the loop sections 166, 168 together.

FIGS. 10A-B show a racing order indicator 156. In this illustrative embodiment, the racing order indicator 156 includes a support structure 174 that extends across a plurality of lanes of a connected track segment, and a plurality of contact members or paddles 176, 178, 180, 182. The racing order indicator 156 is configured to indicate which of a plurality of toy vehicles traveling along the plurality of lanes was the race leader at a predetermined point on the track, for example the first vehicle to reach the end of the raceway.

The four paddles 176, 178, 180, 182 extend from the support structure 174 and are configured to pivot individually between a first position (see, e.g., paddle 176 in FIG. 10A) and a second position (see, e.g., paddle 176 in FIG. 10B). When in the first position, the paddle at least partially obstructs its corresponding lane. The paddle is configured to pivot from the first position to the second position in response to a toy vehicle contacting the paddle while traveling in its corresponding lane. If a first toy vehicle contacts the first paddle before any of the remaining vehicles contacts a respective second, third or fourth paddle, the first paddle moves to the second position and provides an indication that the first toy vehicle was the first to reach the racing order indicator 156. When two or more of the paddles are contacted by toy vehicles and moved into the second position, the paddles form a stack arranged in the order in which the toy vehicles contacted the respective paddles. This identifies the order in which the toy vehicles reached the racing order apparatus 156 and contacted the paddles.

One or more elastic biasing members are connected to the paddles and the support structure. The elastic biasing member may be any suitable structure or element that may be adapted to urge the paddle from the first position to the second position, such as a spring (e.g., coil spring, flexion, bending type spring) or an elastic loop (e.g., rubber band, O-ring). As shown in FIG. 10B, the elastic loops 184 are secured to the paddles 176, 178, 180, 182 and induce a rotational moment to the paddles. A holding moment induced by an over-center positioning of the paddles 176, 178, 180, and 182 allows the paddles to be retained in the first position. A toy vehicle only needs to slightly contact and/or move a paddle before the biasing effect of the elastic loop 184 urges the paddle towards the second position.

The paddles 176, 178, 180, 182 are positioned in a radial array relative to a display region 186. The display region 186 is configured to display an indication of which of the toy vehicles traveling along the plurality of lanes was the first vehicle to reach the racing order indicator 156. The display region 186 includes an aperture extending through the support structure 174. Each of the paddles 176, 178, 180, 182 includes a display surface 188 that is displayed through the aperture when the paddle is in the second position. The display surfaces 188 of the paddles each has an indicia (i.e., "1", "2", "3", and "4") associated with the corresponding lanes. The indicia are suitably rotated so that the indicia are appropriately oriented when the display surface 188 is visible through the aperture.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention.

Finally, various features from one of the embodiments may be incorporated into another of the embodiments. Accordingly, it is appropriate that the appended claims be construed broadly and in a manner consistent with the scope of the disclosure as set forth in the following claims.

The invention claimed is:

1. A toy vehicle track set, comprising:

a plurality of track segments, wherein each track segment of the plurality of track segments has a coupling portion, one track segment of the plurality of track segments is a main track segment, and one or more other track segments of the plurality of track segments are hingedly coupled to the main track segment;

the plurality of track segments being collectively positionable in a racing configuration and a transport configuration, wherein the plurality of track segments are coupled together to form a multi-lane raceway in the racing configuration and the one or more other track segments pivot about the main track segment to form a rectilinear transport structure in the transport configuration, the rectilinear transport structure including four walls extending vertically from the main track segment so that the main track segment and the four walls collectively define a cavity.

2. The toy vehicle track set of claim 1, wherein each track segment of the plurality of track segments defines the rectilinear transport structure or is stored within the cavity when the toy vehicle track set is in the transport configuration.

3. The toy vehicle track set of claim 1, wherein at least one track segment of the plurality of track segments is separable from other track segments of the plurality of track segments to enable reconfiguration between the racing configuration and the transport configuration.

4. The toy vehicle track set of claim 1, wherein the four walls are formed by track segments of the plurality of track segments that are inseparably hingedly coupled to the main track segment.

5. The toy vehicle track set of claim 1, wherein one end of the plurality of track segments includes a hinged male connector and an opposite end of the plurality of track segments includes a female connector.

6. The toy vehicle track set of claim 1, wherein at least one track segment of the plurality of track segments includes a plurality of upstanding parallel ribs that define a plurality of lanes.

7. The toy vehicle track set of claim 1, wherein a first track segment of the plurality of track segments includes a directional indicator for orienting the first track segment when being coupled to another track segment of the plurality of track segments.

8. The toy vehicle track set of claim 1, wherein at least one track segment of the plurality of track segments is selected from the group consisting of a straight track, a loop, a racing order indicator, and a starting gate assembly.

9. The toy vehicle track set of claim 1, further comprising a toy vehicle launcher that is coupleable to one of the plurality of track segments.

10. The toy vehicle track set of claim 1, wherein one track segment of the plurality of track segments includes a pivotable support member configured to support the one track segment in an angular position.

11. The toy vehicle track set of claim 1, wherein at least one track segment of the plurality of track segments is a foldable track segment and includes two pivotable support members configured to support the folded track segment in a zig-zag configuration.

12. The toy vehicle track set of claim 11, wherein the foldable track segment further includes a hingedly connected multi-lane racing surface.

13. The toy vehicle track set of claim 1, wherein:

at least one track segment of the plurality of track segments is a separable track segment that is separable from other track segments of the plurality of track segments to enable reconfiguration between the racing configuration and the transport configuration; and at least one of the four walls retains one of the separable track segments while the toy vehicle track set is in the transport configuration.

14. The toy vehicle track set of claim 1, wherein the plurality of track segments further comprises:

two support track segments that each define at least a portion of one of the four walls, the two support track segments being configured to pivot about axes that are collinear with opposite side edges of the main track segment and to provide elevation to the main track segment in the racing configuration.

15. The toy vehicle track set of claim 1, wherein one of the four walls is configured to be folded to form a top lid of the rectilinear transport structure.

16. The toy vehicle track set of claim 1, wherein at least one track segment of the plurality of track segments includes a latch configured to releasably engage with another track segment of the plurality of track segments while the toy vehicle track set is in the transport configuration.

17. The toy vehicle track set of claim 1, wherein a first subset of track segments from the plurality of track segments define the rectilinear transport structure, a second subset of track segments from the plurality of track segments are storable in the rectilinear transport structure, and the second subset includes only track segments not included in the first subset.

18. A toy vehicle track set, comprising:

a main track segment including an entrance, an exit, and opposing sides;

four wall segments hingedly coupled to the entrance, the exit, and the opposing sides of main track segment so that the four wall segments can pivot about axes collinear with the entrance, the exit, and the opposing sides, to orthogonal positions along edges of the main track segment to form a rectilinear transport structure that defines a cavity; and a plurality of connectable track segments, each connectable track segment of the plurality of connectable track segments being coupleable to one of the four wall segments and/or one of the plurality of connectable track segments to construct a raceway for toy vehicles or being storable within the cavity for transport of the toy vehicle track set.

19. The toy vehicle track set of claim 18, wherein the plurality of connectable track segments set is contained within the rectilinear transport structure when the toy vehicle track set is in a transport configuration.

20. The toy vehicle track set of claim 18, wherein one wall of the four wall segments includes a pivotable support member configured to selectively support the one wall in an angular position.

* * * * *